US005704473A

United States Patent [19]

Oster

[11] Patent Number: 5,704,473

[45] Date of Patent: Jan. 6, 1998

[54] MUSIC STRINGS AND PACKAGING

[75] Inventor: Doran M. Oster, Gainesville, Fla.

[73] Assignee: Sabine, Inc., Alachua, Fla.

[21] Appl. No.: 645,415

[22] Filed: May 13, 1996

[51] Int. Cl.[6] ..... A45C 11/00

[52] U.S. Cl. ..... 206/314; 206/49; 206/227; 206/388; 84/297 S

[58] Field of Search ..... 206/49, 225, 303, 206/314, 388, 410, 497, 63.6, 380, 227; 84/297 S

[56] References Cited

U.S. PATENT DOCUMENTS

| | | | |
|---|---|---|---|
| 488,005 | 12/1892 | Griffith | 229/72 |
| 607,130 | 7/1898 | Rapp | 206/314 |
| 718,114 | 1/1903 | Finney | 206/391 X |
| 2,295,260 | 9/1942 | Kaplan | 206/314 |
| 3,029,569 | 4/1962 | Taylor . | |
| 3,037,619 | 6/1962 | Stevans | 206/63.3 |
| 3,130,626 | 4/1964 | Martin . | |
| 3,283,469 | 11/1966 | McBrady et al. . | |
| 3,352,416 | 11/1967 | Lo Duca | 206/314 |
| 3,398,500 | 8/1968 | Inman . | |
| 3,618,282 | 11/1971 | Hagel et al. | 206/314 X |
| 3,777,613 | 12/1973 | Chaffee et al. | 84/297 S |
| 3,826,171 | 7/1974 | Kaar | 84/297 S |
| 3,877,570 | 4/1975 | Barry | 206/63.3 |
| 4,055,672 | 10/1977 | Hirsch et al. | 206/525 |
| 4,164,806 | 8/1979 | Stone et al. . | |
| 4,866,911 | 9/1989 | Gindrod et al. | 53/432 |
| 4,897,276 | 1/1990 | Locke et al. | 206/521 |
| 4,899,517 | 2/1990 | Shima et al. | 53/403 |
| 5,129,514 | 7/1992 | Lilley, Jr. | 206/388 |
| 5,209,042 | 5/1993 | Rickard | 53/430 |
| 5,372,057 | 12/1994 | Hart | 84/297 S |

*Primary Examiner*—David T. Fidei
*Attorney, Agent, or Firm*—Donald W. Marks

[57] ABSTRACT

A metal musical string having a plastic or polymer material covering an end of the string opposite to a ball end of the string is contained in a flexible enclosure or pouch. In a coiled configuration, the ends of the string are twisted around convolutions of the coil to maintain the coil configuration. Different colors of polymer material cover ends of respective different music strings to identify the strings contained in the single pouch. The polymer material is either thin to allow insertion through holes or slots of musical instruments or removable. The flexible enclosure is a sealed gas impervious pouch filled with a non-corrosive gas such as nitrogen, carbon dioxide, argon, helium, etc.

11 Claims, 2 Drawing Sheets

MUSIC STRINGS AND PACKAGING

TECHNICAL FIELD

The present invention relates to music strings, such as guitar strings, and packaging techniques and materials.

BACKGROUND ART

Guitar strings are generally packaged in individual paper envelopes which are printed with information identifying the strings. The strings are metal wires of high tensile strength and high bending elasticity which, when packaged, are normally coiled with ends twisted around the convolutions to hold the coil configuration prior to placing in the paper envelopes. The six different gauges of strings for a guitar in their paper envelopes are often placed into a plastic pouch and sold as a unit. Recently, strings for a guitar have been sold in plastic pouches without individual paper envelopes; the strings are identified by colored balls or coatings on the ball ends as described in U.S. Pat. No. 3,130,626. Additionally U.S. Pat. No. 4,164,806 discloses marking balls on string ends with numbers to identify the strings.

One problem with prior art packaged music strings is that the non-balled end is generally a cut end with a sharp point. During installation, the cut end protrudes from the winding post and the musician can easily poke his or her finger. Also the resilience or elasticity of the string tends to cause the ends of the string to fly out when the ends of the string are untwisted from a packaged coiled configuration; for example, the musician can be poked in the eye by the sharp string end to cause serious injury.

Another problem concerning marketing of musical strings is that after a period of time the strings tend to tarnish rendering the strings less saleable. Guitar strings are made from metal or metal alloys which after prolonged exposure to atmospheric oxygen and humidity tend to loose their shiny luster. Musicians prefer to purchase strings which have the appearance of being shiny and new.

SUMMARY OF THE INVENTION

The invention is summarized in a flexible enclosure containing a metal musical string having a polymer material with a smooth surface covering an end of the string opposite to a ball end of the string. The plastic material reduces a hazard of the non-ball end of the string poking a musician while uncoiling and installing the string.

One object of the invention is to provide a musical string package which has reduced tendency to cause injury.

An advantage of the invention is that the smooth surface of the polymer material covering the sharp cut end opposite to the ball end of a metal musical string greatly reduces hazards of poking a musician installing the string on a musical instrument.

Additional features of the invention include the provision in one embodiment that the covering of polymer material be relatively thin so that the covered end can be inserted through normal string receiving openings in musical instruments; the alternative provision of a polymer material covering for a cut end of a music string which is removable to allow the cut end to be easily inserted through holes or slots of musical instruments; the provision of a sealed gas impervious pouch containing one or more music strings and filled with a non-corrosive gas; and the provision of different colors of polymer material covering respective different music strings to identify the strings contained in a single pouch.

Other objects, advantages and features of the invention will be apparent from the following description of the preferred embodiments and accompanying drawings.

DESCRIPTION OF THE PREFERRED EMBODIMENTS

Figure 1:
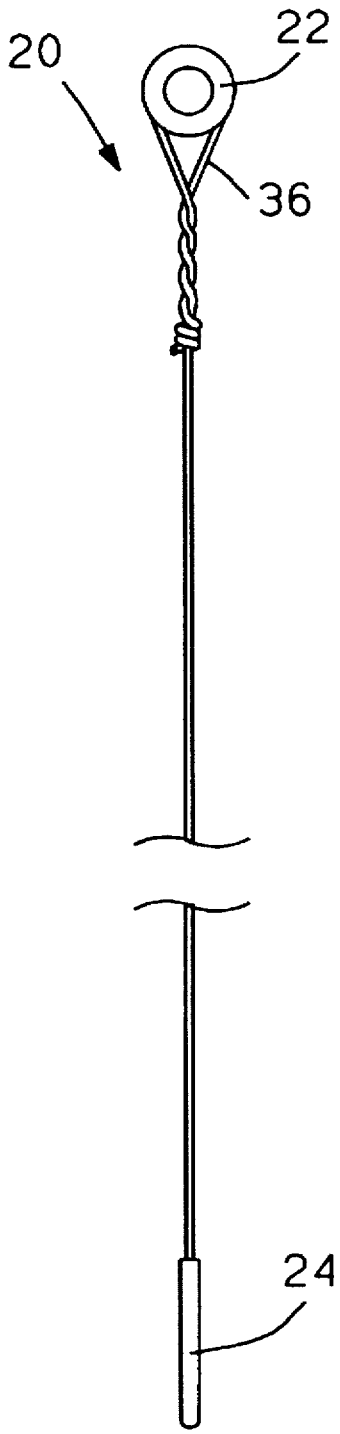
FIG. 1 is a plan view of a music string, with a center portion broken away, in accordance with the invention.

In accordance with one embodiment of the invention as illustrated in FIG. 1, a metal music string such as a guitar string 20 has a ball 22 secured at one end and a polymer or plastic material 24 covering the opposite end. The polymer material 24 covers any sharp point on the cut end of the string opposite to the ball end 22 and has a relatively smooth surface preventing the covered end from poking and injuring the musician installing the string.

Figure 2:
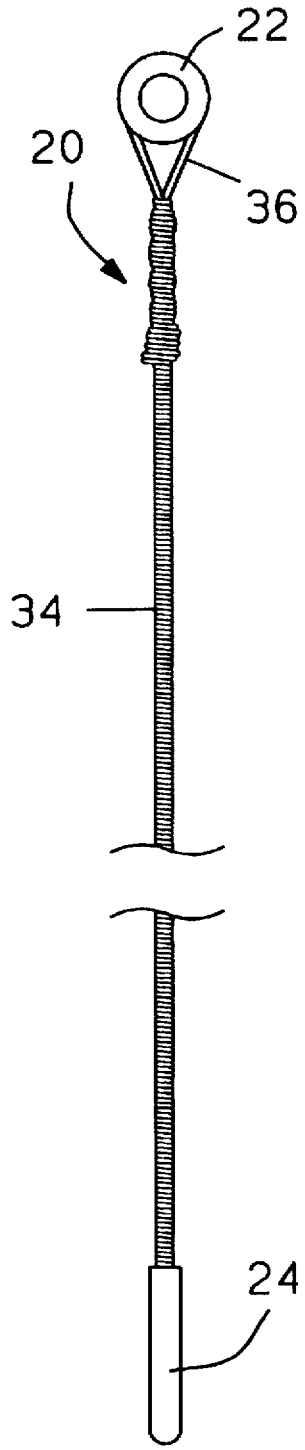
FIG. 2 is a plan view similar to FIG. 1 of a variation of the music string in accordance with the invention.

The musical string 20 is principally a metal wire. Many different metals or alloys, for example, steel, nickel, etc., are suitable for use in musical strings. Generally the metals or alloys are relatively non-malleable with high tensile strength and high bending resilience. The embodiment of FIG. 2 illustrates a musical string wherein a metal core wire is covered by a winding of a smaller diameter metal wire. In further alternative embodiments, the core can be a polymer or other non-metal strand which is covered by a winding of metal wire, or the core can be a metal wire covered by a winding of thin polymer or other non-metal strand material. Typically a musical instrument employs a plurality of strings of different gauges. For example, a guitar can employ six strings with the three smallest gauge strings being single strand wires of varying gauge and with the three larger gauge strings being of the winding covered type of varying gauge.

Figure 3:
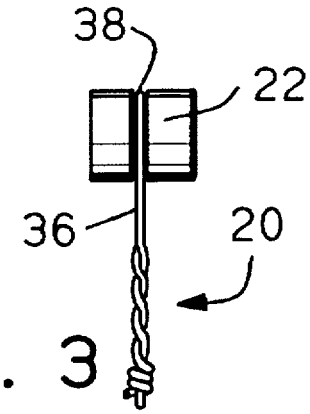
FIG. 3 is a side view of ball end of the music string of FIG. 1.

The ball 22 as shown in FIGS. 1 and 3 is a cylindrical member secured in a loop 36 formed in one end of the wire string which is twisted about itself to maintain the loop. The cylindrical member 22 has a central circumferential groove 38 in which the wire loop 36 is secured. In the illustrated the embodiment, the member 22 is a hollow metal member. However various other cylindrical, round or polyhedron configurations of metal, plastic, or other suitable material can be used as the ball 22. Additionally the ball 22 can be secured by various other techniques such as molding, welding, crimping, etc., to the end of the music string 20.

The polymer material 24 is preferably a cover material formed by dipping the opposite end (opposite to the ball end) of the music string in a plastic or rubber coating solution such as those commonly used to form an insulating coating on tool handles. Generally this opposite end of the music wire is a cut end and will have one of more sharp points. The coating is cured or dried by hanging the music wires from their ball ends. The polymer coating is generally about 0.02 to 2.5 millimeters thick and preferably from 0.1 to 1.5 millimeters thick which effectively prevents injury from poking of the cut end of the wire. The length of the coating along the wire is selected to be adequate for retention and for visibility; lengths generally from 5 millimeters to 50 millimeters and preferably from 10 to 30 millimeters can be used.

In one preferred embodiment, the polymer coating 24 is relatively thin, generally less than about 1 millimeter and preferably less than about 0.5 millimeters (0.1 to 0.5 millimeters), so that the covered end of the wire can be inserted through normal wire receiving openings such as holes or slots in bridge members and winding or tuning posts of the musical instrument. Generally the maximum diameter of the covered end of guitar strings is less than about 2 millimeters to permit passage through the music string receiving openings of musical instruments. In this embodiment the coating is not intended to be removed except that the coated end can be cut off after installation.

Figure 5:
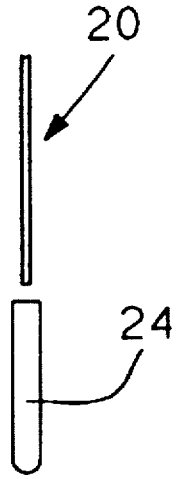
FIG. 5 is a plan view of a still further variation of the covered end of the music string showing removal of an alternative polymer material covering the opposite end.

In an alternative embodiment, the polymer coating is designed to be removed. The polymer material 24 adheres sufficiently to the music wire to remain on the cut end during handling and packaging, but does not adhere sufficiently to prevent its removal by gripping and pulling by a musician as shown in FIG. 5. For thick polymer coatings such as relatively thick rubber coatings, it is desirable for the material 24 to be removable by the musician to enable the exposed end of the music string to be more easily threaded through a small hole or slot in a member such as a rotatable post for attaching and/or tightening the string on a musical instrument.

Figure 4:
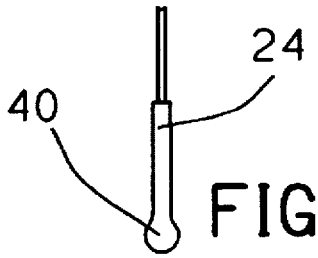
FIG. 4 is a plan view of a further variation of the covered end of a music string in accordance with the invention.

Additionally the coating 24 can have a distal bulbous end 40 on the end of the music wire such as illustrated in FIG. 4. For larger bulbous ends 40, the coating of FIG. 4 is removable. However for slight or relatively small enlargements of thin coatings, the bulbous ends can be inserted through the openings in the musical instrument and need not be designed for removal.

The polymer material also has different colors for the different gauges of the music strings so that the color of the polymer material can be used to identify the gauge of the music string.

Many different types of polymer material can possibly be employed to form the coating 24. These include various natural and synthetic materials including latexes, silicones, polymers, resins, paint, and other materials which can be applied by dipping in curable liquid or gel solutions and form relatively smooth exterior surfaces when cured. It is not necessary that the coating be highly elastomeric but should be sufficiently flexible or malleable to bend through a slight curve without breaking. For removable coatings, resilient or elastic materials resist removal by normal handling and packaging but permit removal by pulling.

Figure 6:
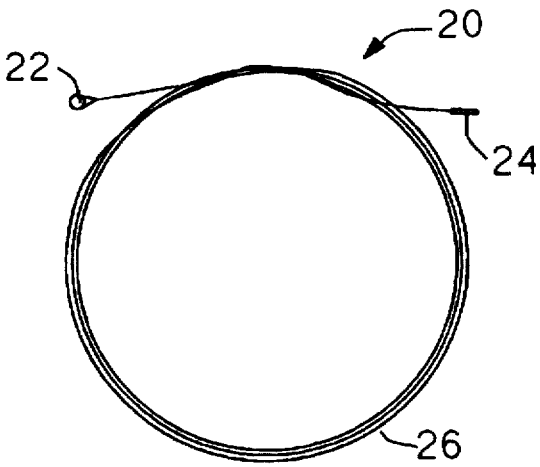
FIG. 6 is a plan view showing the music string of FIG. 1 coiled.
Figure 7:
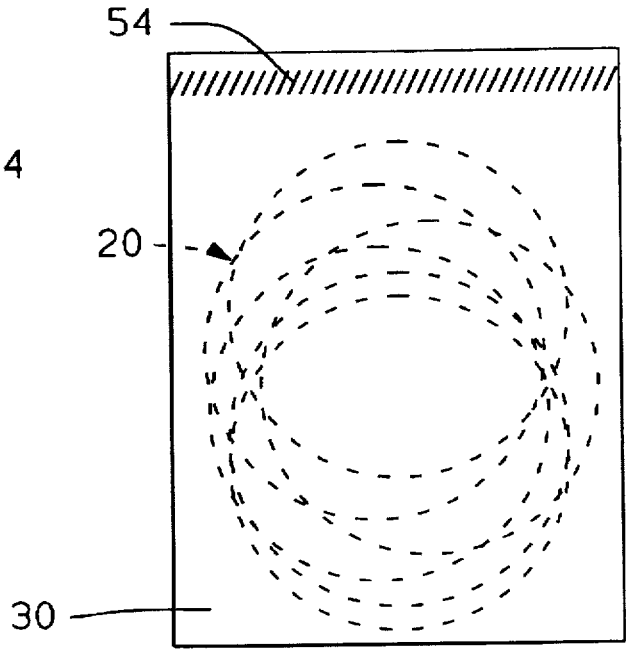
FIG. 7 is a plan view of a sealed pouch with a plurality of coiled music strings.

After curing the polymer material on the end of the musical string, the string is coiled to form a plurality of convolutions, such as about 3½ convolutions for a guitar string as shown in FIG. 6, and the ball end and/or the covered end is twisted, for example twice for one end or once in opposite directions for the respective ends, about the convolutions to maintain the coiled configuration. This coiled music string is then placed in a flexible enclosure such as the pouch 30 of FIG. 7. If the music string is being sold individually, then only one coiled string is placed in the pouch. But if the music string is being sold in a set, such as six guitar strings, then the plurality of strings forming the set, such as a set of six guitar strings, is placed in a single pouch. The pouch can have color markings and/or printing to identify the gauge of the string or strings.

Figure 8:
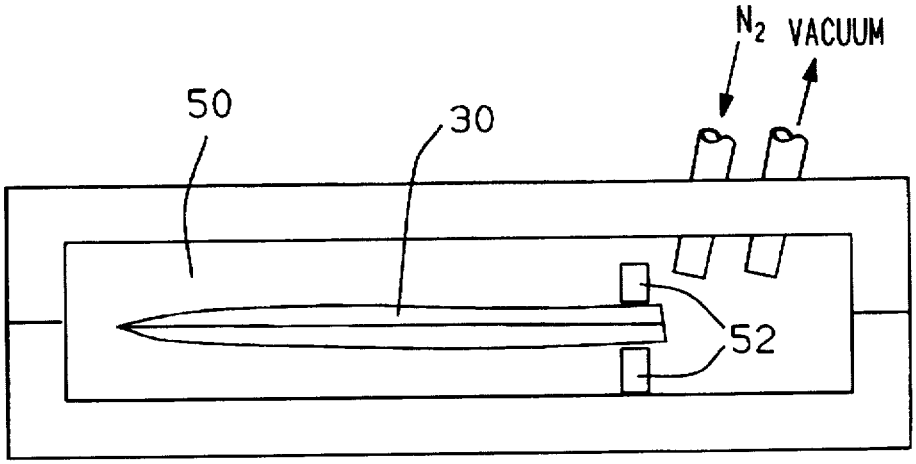
FIG. 8 is a diagrammatic section view of an apparatus for sealing pouches with music strings.

Preferably the pouch 30 is formed from impervious flexible film such as a multi-layer film wherein an intermediate layer is metal. As shown in FIG. 8, the pouch which can be previously sealed on three sides, or formed with three closed sides, is placed in a closed chamber 50. The chamber 50 and the pouch are first evacuated, then filled with a non-corrosive gas such as dry nitrogen, carbon dioxide, argon, helium, neon, etc., and finally partially evacuated prior to being sealed along the fourth side by sealing members 52 to form a seal 54, FIG. 7, which completes the seal of the pouch. The sealed pouch which contains the non-corrosive gas prevents exposure of the coiled music strings to atmospheric oxygen and humidity to prevent tarnish of the metal strings. Thus the purchaser of the packaged music string or strings is assured of buying a music string or strings which have retained the new string lustre even though the packaged strings may have been stored or placed on a shelf for many months or even for a few years.

Alternatively the musical strings can be packaged in long narrow pouches (not shown) or tubes (not shown) without coiling. The length of the long pouches is greater than the length of the musical string so that one musical string or a set of musical strings can be sealed straight or uncoiled in a long pouch along with non-corrosive gas.

Since many variations, modifications, and changes in detail can be made to the embodiments described in the above description, it is intended that the foregoing description and accompanying drawings be interpreted as only illustrative of one or more preferred embodiments and not as limiting on the variations and changes that can be made without departing from the scope of the invention as set forth in the following claims.

What is claimed is:

1. A musical string and package comprising:

a metal string adapted to fit on a musical instrument;

a ball secured to one end of the string for aiding in attachment of the string to the musical instrument;

a flexible polymer material with a smooth surface covering the other end of the metal string; and a flexible enclosure containing the metal string.

2. A musical string and package as claimed in claim 1 wherein said metal string is coiled to form a plurality of convolutions and has an end twisted around the coil convolutions to maintain the coil configuration.

3. A musical string and package as claimed in claim 1 wherein the flexible enclosure is a sealed gas impervious pouch containing a non-corrosive gas.

4. A musical string and package as claimed in claim 2 wherein the flexible enclosure is a sealed gas impervious pouch containing a non-corrosive gas.

5. A musical string and package as claimed in claim 1 wherein the covering of the polymer material has a thickness in the range from 0.02 to 2.5 millimeters.

6. A musical string and package as claimed in claim 1 wherein the covering of the polymer material is sufficiently thin to permit the other end of the metal string to be inserted through normal string receiving openings in the musical instrument.

7. A musical string and package as claimed in claim 6 wherein the covering of the polymer material has a thickness in the range from 0.1 to 0.5 millimeters.

8. A musical string and package as claimed in claim 1 wherein the covering of the polymer material is removable from the other end of the string.

9. A musical string and package as claimed in claim 1 wherein the polymer material is colored to identify the musical string.

10. A musical string and package as claimed in claim 1 including a plurality of musical strings with balls secured to one ends of the strings and with different color polymer material covering the other ends of the respective strings to identify the strings, each of said metal strings being coiled to form a plurality of convolutions and having an end twisted around the coil convolutions to maintain the coil configuration; and wherein said flexible enclosure is a sealed gas impervious pouch filled with nitrogen and containing the coiled metal strings.

11. A musical string and package as claimed in claim wherein the polymer material is a coating applied by dipping the other end of the musical string in a liquid material and curing the coating.

* * * * *